US011292044B2

(12) United States Patent
Nillies

(10) Patent No.: US 11,292,044 B2
(45) Date of Patent: Apr. 5, 2022

(54) DEVICE AND METHOD FOR FORMING

(71) Applicant: Leifeld Metal Spinning AG, Ahlen (DE)

(72) Inventor: Benedikt Nillies, Ahlen (DE)

(73) Assignee: Leifeld Metal Spinning AG, Ahlen (DE)

( * ) Notice: Subject to any disclaimer, the term of this patent is extended or adjusted under 35 U.S.C. 154(b) by 202 days.

(21) Appl. No.: 16/462,423

(22) PCT Filed: Nov. 29, 2017

(86) PCT No.: PCT/EP2017/080793
§ 371 (c)(1),
(2) Date: May 20, 2019

(87) PCT Pub. No.: WO2018/162106
PCT Pub. Date: Sep. 13, 2018

(65) Prior Publication Data

US 2019/0275579 A1 Sep. 12, 2019

(30) Foreign Application Priority Data

Mar. 8, 2017 (EP) ..... 17159801

(51) Int. Cl.
*B21D 22/14* (2006.01)
*B21D 37/04* (2006.01)
*B21D 43/00* (2006.01)

(52) U.S. Cl.
CPC ..... *B21D 22/14* (2013.01); *B21D 37/04* (2013.01); *B21D 43/00* (2013.01)

(58) Field of Classification Search
CPC .. B21D 22/14–18; B21D 43/00; B21D 43/02; B21D 43/04
(Continued)

(56) References Cited

U.S. PATENT DOCUMENTS 4,047,413 A * 9/1977 Lewis ..... B21D 22/16 72/83
2003/0173778 A1* 9/2003 Sakamoto ..... B21D 19/02 285/288.1
(Continued)

FOREIGN PATENT DOCUMENTS

CN 102059352 A 5/2011
CN 202387812 U 8/2012
(Continued)

OTHER PUBLICATIONS

Masuharu, Translation of JP-2529879 (JPH026024) (Year: 1990).*
(Continued)

*Primary Examiner* — Gregory D Swiatocha
*Assistant Examiner* — Bobby Yeonjin Kim
(74) *Attorney, Agent, or Firm* — Studebaker & Brackett PC

(57) ABSTRACT

The invention relates to a device and a method for forming, in which at least one spindle is driven in a rotating manner by means of a rotary drive, a workpiece is received on the spindle by means of a clamping means and clamped on the spindle and at least one forming roller is fed axially and/or radially relative to the workpiece in order to carry out a spinning or flow-forming process. In accordance with the invention provision is made for the spindle and the clamping means to be combined to a changing unit which is adjustable transversely to the axis of rotation, wherein the changing unit is adjusted between a forming position and a set-up position.

13 Claims, 3 Drawing Sheets

Figure 2:
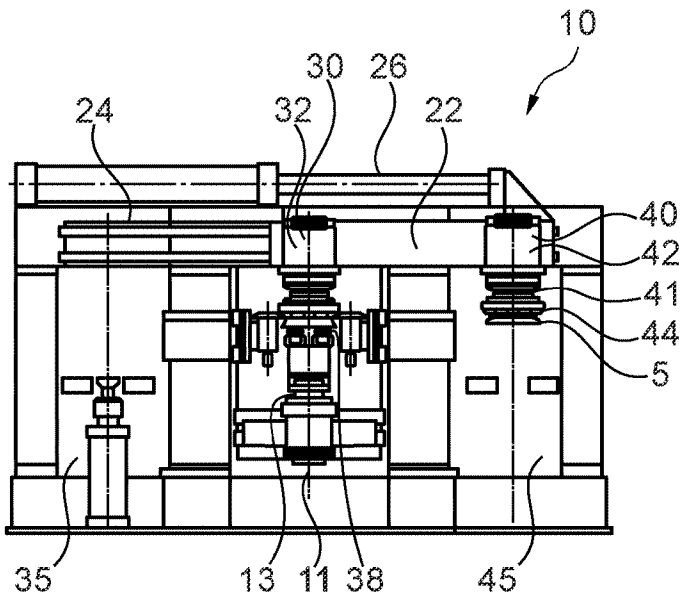

(58) Field of Classification Search
USPC ..... 72/82–85
See application file for complete search history.

(56) References Cited

U.S. PATENT DOCUMENTS

| | | | | |
|---|---|---|---|---|
| 2009/0293688 | A1* | 12/2009 | Nillies | B21D 22/18 82/129 |
| 2012/0048075 | A1* | 3/2012 | Hessbrueggen | B23Q 39/028 82/121 |
| 2018/0229546 | A1* | 8/2018 | Seung | B60B 1/08 |

FOREIGN PATENT DOCUMENTS

| | | | | |
|---|---|---|---|---|
| CN | 205798097 | U | 12/2016 | |
| DE | 102007012765 | B4 | 3/2013 | |
| JP | H02-6024 | A | 1/1990 | |
| JP | 2529879 | B2 * | 9/1996 | B21D 43/00 |

OTHER PUBLICATIONS

An Office Action mailed by China National Intellectual Property Administration dated Mar. 20, 2020, which corresponds to Chinese Patent Application No. 201780068039.9 and is related to U.S. Appl. No. 16/462,423 with English language translation.
International Preliminary Report on Patentability issued in corresponding International Application No. PCT/EP2017/080793; dated Sep. 19, 2019.
International Search Report issued in PCT/EP2017/080793; dated Mar. 23, 2018.

* cited by examiner

DEVICE AND METHOD FOR FORMING

The invention relates to a device for forming having at least one spindle which can be driven in a rotating manner by a rotary drive, a clamping means which is arranged on the spindle and designed to receive and clamp a workpiece on the spindle, and at least one forming roller which can be fed axially and/or radially relative to the workpiece in order to carry out a spinning or flow-forming process, in accordance with the preamble of claim 1.

The invention further relates to a method for forming, in which at least one spindle is driven in a rotating manner by means of a rotary drive, a workpiece is received on the spindle by means of a clamping means and clamped on the spindle and at least one forming roller is fed axially and/or radially relative to the workpiece in order to carry out a spinning or flow-forming process, in accordance with the preamble of claim 11.

The flow-forming method is an efficient process in particular for manufacturing rotationally symmetrical parts in serial production. Flow-forming methods are especially advantageous in the production of gear parts, such as belt pulleys and rollers, vehicle wheels as well as a variety of other products.

Especially in the serial production of heated parts or of relatively large and heavy parts it is necessary to provide an automatic supply and discharge means. In many cases, handling means with grippers or multiaxial robots are used for this purpose. The supply and discharge of workpieces generally proves to be difficult since the workspace inside the flow-forming machine is limited. In addition, during operation the workspace is closed by a housing as a splash protection for cooling liquid required in the operation, restricting accessibility to a further extent. To avoid a collision of the workpiece with the machine the transfer movement has to be effected with a high degree of precision and therefore at a relatively slow speed. This takes time and reduces the effective machine utilization.

A known device for forming using flow-forming is known from DE 10 2007 012 765 B4, in which case separate supply and discharge means are provided.

Generic devices can be taken from CN 202 387 812 U and CN 205 798 097 U. A bowl-shaped workpiece is clamped on a column-like spindle which is then displaced horizontally into a forming position.

U.S. Pat. No. 4,047,413 discloses an automatic spinning device, in which a plurality of spindles having a workpiece each are arranged in a ring-shaped manner around central spinning rollers. The ring-shaped spindle arrangement is rotated about a central axis.

The invention is based on the object to provide a device and a method for forming, with which a particularly efficient set-up is rendered possible.

The object is achieved on the one hand by a device having the features of claim 1 and on the other hand by a method having the features of claim 11. Preferred embodiments of the invention are stated in the respective dependent claims.

The device according to the invention is characterized in that the spindle and the clamping means are combined to a changing unit which is adjustable transversely to the axis of rotation, and in that the changing unit is adjustable between a forming position of the device and a set-up position.

A basic idea of the invention resides in the fact that a workpiece is supplied to or discharged from a device for forming by adjusting the spindle with the clamping means from the limited workspace out of the forming position into a more easily accessible set-up position. In this set-up position the workpiece can be supplied or discharged and clamped in an easy way. After this handling process the spindle with the clamping means can be returned into the flow-forming position, in which the spinning or flow-forming operation or operations are then carried out. For this purpose, the spindle and the clamping means are combined to a unit which can be referred to as a changing or displacement unit. Spinning is a rotational forming process without any substantial change of the wall thickness, whereas in flow-forming wall thicknesses are selectively reduced and/or increased. Within the meaning of the invention, forming is to be understood in general terms and also comprises profiling, upsetting, stretching and the like.

Due to the concept according to the invention of displacing the spindle with the clamping means into a set-up position a supply means can be simplified significantly. This makes it possible to simplify handling robots considerably or to replace them by a simple transfer means. This reduces costs to a substantial degree. In addition, a manual set-up can be simplified too. Another advantage of the invention resides in the fact that, where appropriate, even further set-up operations or maintenance works on the spindle and the clamping means are simplified by the more easily accessible set-up position. By preference, the set-up position is located on the outside of the workspace and the housing of the device. The set-up position can also be used for the change of the spinning tool that is fixed on the spindle, for pretreatment of the workpiece, such as heating, or for other functions.

A preferred further development of the invention resides in the fact that the changing unit has the rotary drive. In this way, the entire changing unit with the rotary drive can be displaced between the set-up position and the flow-forming position. For this, the supply lines for the rotary drive are designed in an appropriately flexible way. For the changing unit provision is made in particular in the forming position for an alignment means so that the changing unit can always assume the precise flow-forming position in the workspace. In the operating or forming position the workpiece can be clamped and held on the spindle on two sides with an additional counter-holder or only on one side by the clamping means.

According to the invention a particularly rapid set-up is achieved in that a first changing unit with a first spindle and a first clamping means and at least one second changing unit with a second spindle and a second clamping means are provided and in that the first changing unit and the at least second changing unit are alternately adjustable between the forming position and the set-up position. In doing so, one changing unit can be located in the forming position in the machine, whereby a processing of the workpiece is carried out. At the same time, the second changing unit is located on the outside of the workspace of the machine in the set-up position. In this, a processed workpiece can be removed and a workpiece to be newly processed can be inserted into the clamping means of this changing unit. Thus, a set-up and non-productive machine time is combined with a processing or main machine time. This increases the degree of utilization of the machine considerably. As soon as the processed workpiece has been completed the two changing units are changed over so that a further processing can be commenced immediately. In principle, provision can also be made for more than two changing units, by preference three or four changing units.

A preferred embodiment of the invention resides in the fact that the at least one changing unit is supported in a linearly displaceable manner. By preference, a set-up position can in each case be provided on both sides of the device. For instance at least one first changing unit is always displaced to a first set-up position while the at least one second changing unit is displaced from the forming position into a second set-up position that is spaced from the first set-up position.

Alternatively or additionally, according to a further development of the invention provision can be made for the at least one changing unit to be supported in a pivotable manner. For example two changing units can be reciprocated in a turret-like manner about a pivot axis through rotation between the flow-forming position and the set-up position. This permits a particularly quick change.

Provision can be made for several changing units that are displaceable independently of each other. An especially efficient embodiment of the device according to the invention is accomplished in that the first changing unit and the at least one second changing unit are arranged on a joint adjustment element. The joint adjustment element can be a linearly displaceable carriage or a pivotable rotary table. Thus, through a single changing movement and a single adjustment drive the at least two changing units can be moved and adjusted simultaneously.

According to an embodiment variant of the invention it is preferred that the workpiece can be reclamped from the first changing unit to the second changing unit. For instance on the first changing unit a first spinning tool and on the second changing unit a second spinning tool can be provided which differ from each other. Initially, the workpiece can be clamped in the first spinning tool, with a first side being processed or a first forming step being carried out. Afterwards, in the set-up position the workpiece can be repositioned manually or preferably by an automatic reclamping means to the second changing unit. The workpiece is held on the second spinning tool so that a second processing step can be carried out. In this way, the use of intermediate storage or inflexible multiple-station machines can be dispensed with. The changing units can also be located at the same time or with a time shift in the set-up position.

The device can thus be employed as a flexible multiple-station machine. Depending on the workpiece the device can, in a flexible manner, process two different workpieces as a single-spindle device or process a single workpiece in a follow-on process as a multiple-spindle device. The transfer preferably takes place through loading and unloading by means of conveyor belts with a selectable turning station.

A further development of the invention resides in the fact that the axis of rotation is arranged horizontally or vertically. The changing means according to the invention can be used for both spindle arrangements, in which case a vertical arrangement, more particularly a suspended spindle arrangement proves to be especially advantageous. In such a vertical arrangement the changing movement preferably takes place in a horizontal plane.

Basically, a relative feed of the at least one forming roller is effected by an axial and/or radial adjustment of the forming roller itself. This can be realized by way of appropriate supports for the individual forming rollers. By preference, an axial and/or radial feed movement of the workpiece can also be provided.

An advantageous further development of the invention can be seen in the fact that in order to carry out the spinning or flow-forming process the at least one forming roller is axially stationary, wherein the workpiece is supported in an axially displaceable manner. During the forming process the workpiece clamped on the clamping means is preferably displaced axially with the changing unit.

Within the meaning of the invention, flow-forming not only comprises a forming process with a change of the wall thickness but is to be understood in more general terms so that a forming process with a constant wall thickness, also referred to as spinning, is comprised too.

Furthermore, it is advantageous that a loading and unloading means is provided at the set-up position. This can be a simple mechanism for the supply and/or discharge of the workpiece. Basically, use can also be made of handling means, especially multiaxial robots. Due to the improved accessibility at the set-up position a supply and discharge movement can be carried out relatively quickly without the risk of a collision. A heating of the workpiece by a heating means or a change of the spinning tool, preferably effected by an automatic changing means, are possible too. The tool change can take place in an additional set-up position that is parallel to the first set-up position.

By preference, the forming rollers are driven, preferably with the same forming speed that the workpiece surface has. For this purpose, it may be necessary to automatically adapt the rotational speed in the process. For instance this can be realized by a freewheeling of the drive or an active regulation of the rotational speed.

Furthermore, it is preferred that the at least one forming roller is supported on an adjustable roller support and in that on the roller support a roller changing means is arranged. The roller changing means can in particular be a turret arrangement with a turret carrier, on which several forming rollers of different type are arranged. Through adjustment of the roller carrier the forming roller desired in each case can be adjusted into the processing position. Through this, versatility is improved further and non-productive times for the set-up of the machine are reduced. Provision can be made for a plurality of forming rollers which also act simultaneously on the external and/or internal side of the workpiece.

The method for forming in accordance with the invention is characterized in that the spindle and the clamping means are combined to a changing unit which is adjustable transversely to the axis of rotation, wherein the changing unit is adjusted between a forming position and a set-up position.

The method according to the invention can in particular be carried out on the previously described device. The advantages set out previously can be achieved thereby.

A preferred method variant of the method according to the invention resides in the fact that a first changing unit with a first spindle and a first clamping means and at least one second changing unit with a second spindle and a second clamping means are provided, wherein the first changing unit and the at least second changing unit are alternately adjusted between the forming position and the set-up position. Due to the changing or exchange movement an especially quick workpiece change or a rapid set-up can take place. This reduces non-productive times and increases the main machine time. As a result, the degree of utilization and the efficiency of the machine and of the forming method are improved.

According to a further development of the invention a particularly efficient change is accomplished in that for adjustment between the flow-forming position and the set-up position the at least one changing unit is linearly displaced or pivoted. The linear displacement can be effected e.g. with a positioning cylinder, a ball roller spindle or a linear drive. For pivoting a rotary motor or a positioning cylinder with a corresponding linkage to a pivot mechanism can be provided.

Basically, during forming the workpiece can be axially stationary while being passed over axially by the forming rollers. According to an embodiment variant of the invention it is particularly advantageous that in order to carry out the forming process the at least one forming roller is axially stationary, wherein the workpiece is displaced axially. Due to the fact that the workpiece is already supported on a displaceable changing or displacement unit with the spindle this changing and displacement unit can also be used during flow-forming for the displacement of the workpiece. Through this, an additional axial displacement drive of the forming rollers can be achieved with the corresponding guides.

Moreover, for the push-off of the formed workpiece strippers or ejectors can be provided. In addition, especially the ejector can be designed as a shiftable axis. By preference, the supports for the forming rollers are arranged such that idle travel is as low as possible.

Figure 1:
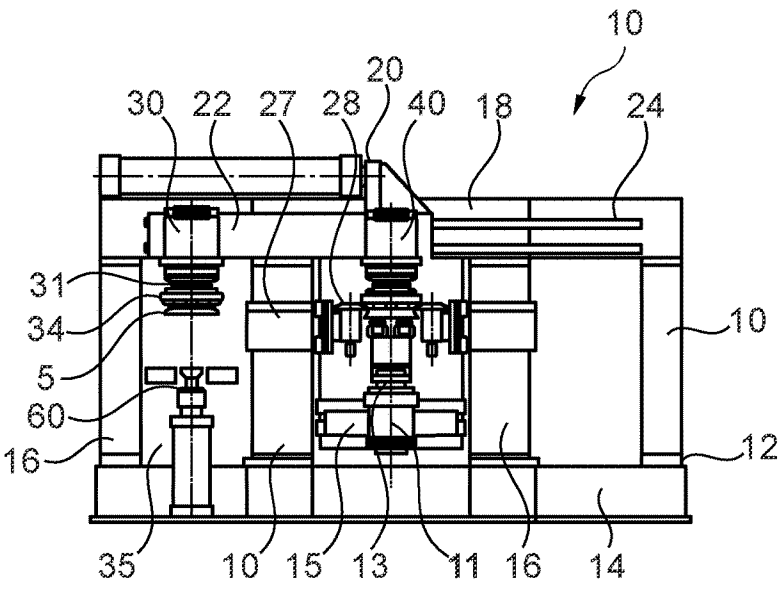
Figure 3:
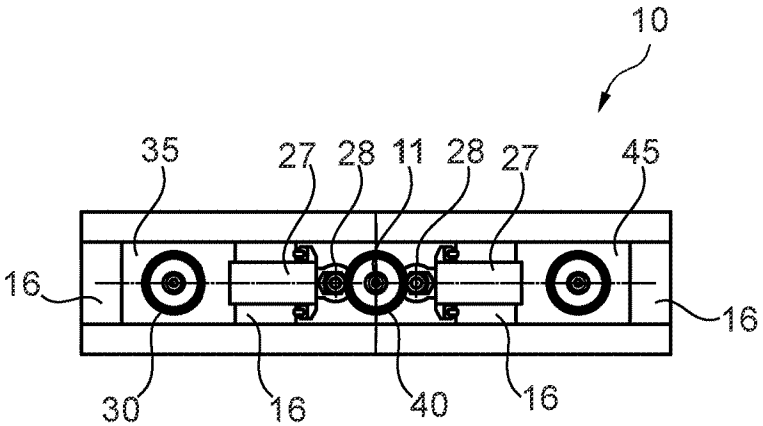
Figure 4:
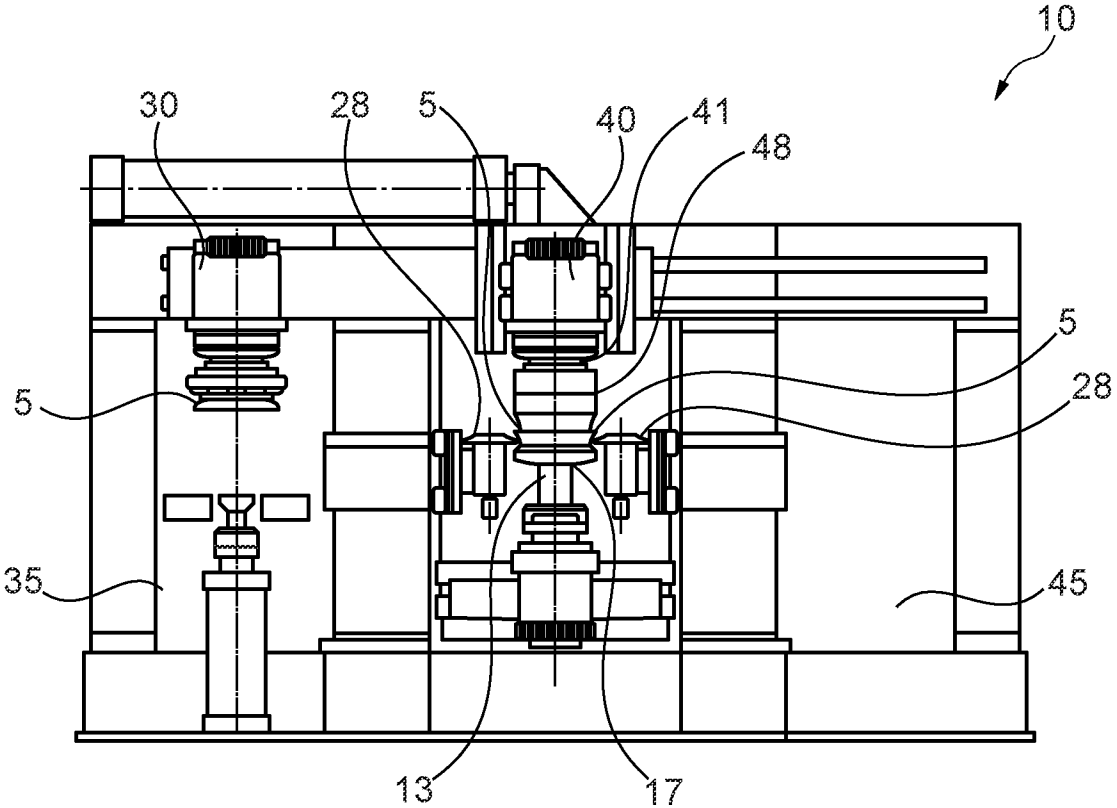
Figure 5:
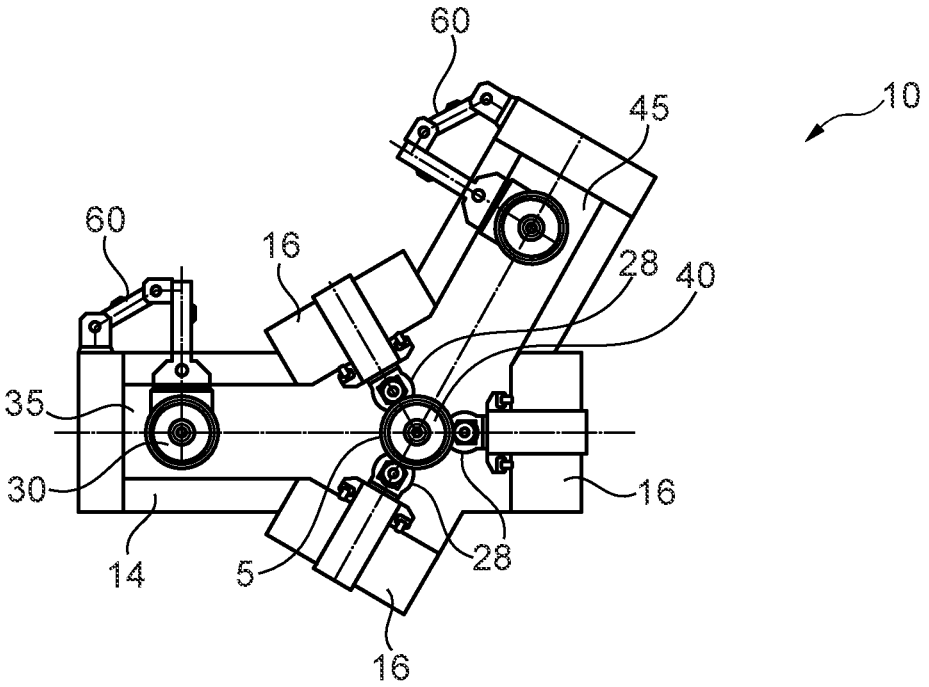
Figure 6:
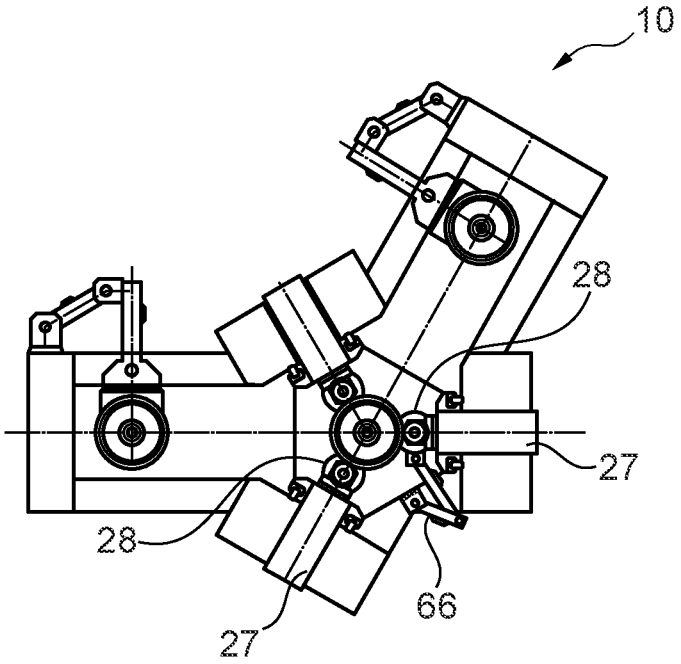

The invention is explained further hereinafter by way of preferred embodiments illustrated schematically in the drawings, wherein show:

FIG. 1 a front view of a device for forming according to the invention in a first operating state;

FIG. 2 a front view of the device of FIG. 1 in a second operating state;

FIG. 3 a top view of the device of FIGS. 1 and 2;

FIG. 4 a front view of a device according to the invention with different changing units;

FIG. 5 a top view of a further device for forming according to the invention; and FIG. 6 a top view of a modified device according to the invention.

A device 10 according to the invention for forming a workpiece 5 is illustrated in FIGS. 1 to 3. The device 10 has an approximately rectangular machine frame 12 with a machine bed 14 and a carrier-like upper part 18 which is connected to the machine bed 14 via a total of four vertical columns 16. On the two inner columns 16 vertically displaceable roller supports 27 are supported, on which a forming roller 28 is in each case supported in a rotatable manner in order to contact the external side of a workpiece 5.

According to FIG. 1 the workpiece 5 is transferred at a first set-up station 35 by a loading and unloading means 60 with a lifting means to a first changing unit 30. The first changing unit 30 has a first spindle 31 which can be driven in a rotating manner by a first rotary drive 32. At the lower end of the first spindle 31 a first clamping means 34 is arranged, in particular a clamping chuck with clamping jaws capable of being fed radially. By means of the first clamping means 34 the cup-shaped workpiece 5 is connected in a torque-proof manner to the first spindle 31 of the first changing unit 30. The first changing unit 30 is fixed on a carriage-like adjustment element 22 which is part of an adjustment means 20 on the upper part 18 of the device 10. The plate-shaped adjustment element 22 is horizontally displaceable along a linear guide 24 arranged along the upper part 18. Furthermore, on the machine frame 12 a hydraulic cylinder is arranged as a linear drive 26 which, together with the adjustment element 22, is designed to carry out a linear shifting movement.

Next to the first changing unit 30 a second changing unit 40 is arranged on the adjustment element 22. The second changing unit 40 is designed identically to the first changing unit 30 and has a second spindle 41, a second rotary drive 42 as well as a second clamping means 44 for clamping another workpiece 5.

Through actuation of the linear drive 26 the first changing unit 30 is displaced from the first set-up station 35, as illustrated in FIG. 1, to a central processing or forming station, as can be taken from the illustration of FIG. 2. During this displacement motion the second changing unit 40 is at the same time displaced from the central forming position into a lateral second set-up position in a second set-up station 45. The previously processed workpiece 5 can be removed by a loading and unloading means 60 not illustrated in FIG. 2. Subsequently, a workpiece 5 to be newly processed can be supplied to the second changing unit 40 and clamped with the second clamping means 44.

During this set-up process at the second changing unit 40 a processing of the workpiece 5 takes place simultaneously at the first changing unit 30 in the forming position according to FIG. 2. In the forming position the workpiece 5 is set into rotation about an axis of rotation 11 by means of the first rotary drive 32. To the rotating workpiece 5 two forming rollers 28 are fed from opposite sides that form an external side of the workpiece 5. The forming rollers 28 are displaceable radially and axially with respect to the workpiece 5.

At the same time, internal rollers 38 are fed to an internal side of the cylindrical workpiece 5. The internal rollers 38 are arranged on a counter-spindle 13 that is vertically displaceable via a carriage 15. The carriage 15 is supported in a displaceable manner along vertical guides on the two inner columns 16. The counter-spindle 13 can be rotationally driven in a passive manner or in an active one by itself by means of a rotary drive.

On completion of the forming operation on the workpiece 5 the first changing unit 30 can be reset by the adjustment means 20 from the central forming position to the lateral first set-up station 35. At the same time, a new workpiece 5 is again supplied at the second changing unit 40 so that a new forming process can take place without any substantial time interruption. The completely processed workpiece 5 is removed at the first set-up station 35 and replaced by a workpiece 5 which is to be newly processed. Afterwards, a further processing cycle can take place.

Another device 10 according to the invention is illustrated in FIG. 4, in which case this largely corresponds to the previously described device 10 according to FIGS. 1 to 3. As a modification of the previously described embodiment the device 10 has two different changing units 30, 40. On the second changing unit 40 a spinning tool 48 is arranged. On the spinning tool 48, which is mounted on a second spindle 41 of the second changing unit 40, the workpiece 5 is clamped. The spinning tool 48 forms at least a part of a clamping means. For axial pressure a pressure plate 17 that is pressed axially against the workpiece 5 is arranged on the vertically displaceable counter-spindle 13. Through a rotary drive the counter-spindle 13 can be driven in synchronism with the second rotary drive 42 on the second changing unit 40. On completion of processing the counter-spindle 13 is displaced in the downward direction while the formed workpiece 5 is held on the spinning tool 48. In this state the second changing unit 40 is displaced to the second set-up station 45 while the first changing unit 30 is at the same time displaced with a workpiece 5 to be newly processed from the first set-up station 35 into the central forming position. The workpieces 5 held by the different changing units 30, 40 can be of different nature and/or processed in a different way.

In FIG. 5 a further device 10 according to the invention is illustrated with a machine bed 14 arranged at an angle. In this machine arrangement a total of three central, vertical columns 16 are arranged. Along these central columns 16 a total of three forming rollers 28 are arranged that are each offset by 120° from each other. Thus, in the forming position a total of three forming rollers 28 can act on the external side of the workpiece 5.

In the illustration according to FIG. 5 the workpiece 5 is located on the second changing unit 40 in the forming position. On completion of the forming process the second changing unit 40 is displaced with the workpiece 5 to a second set-up station 45 on the right side. At the same time or with a time shift thereto a first changing unit 30 can be displaced with a new workpiece 5 from the first set-up station 35 into the forming position.

At the respective set-up station 35, 45 the ready-formed workpiece 5 can be removed by means of a loading and unloading means 60, which is designed as a multiaxial robot with a gripper, from the respective changing unit 30, 40. Subsequently, a blank can be taken from a non-depicted storage place and inserted into the respective changing unit 30, 40.

In FIG. 6 a modified device 10 is illustrated which largely corresponds to the device 10 of FIG. 5. Additionally arranged between two central columns 16 in the region of the roller support 27 is a roller changing means 66 with a multiaxial robot arm. By way of the roller changing means 66 a forming roller 28 can be changed if worn or in the case of a change of shape.

The tool change can take place in an automated way so that the tool is received in a specifically designed set-up position and handed over again after use. For instance, the tools can be removed directly or with auxiliary means e.g. from a tool-changing cart, a changing pallet or an automated magazine. The loading and unloading means 60 can be used e.g. as an auxiliary device for changing the tools.

For reasons of space or of accessibility provision can also be made for at least one alternative position for the tool change. This should be reachable in parallel to the first one through a further radial shift of the changing unit 30, 40. At least one alternative position can be provided per changing unit 30, 40.

FIG. 3, FIG. 5 and FIG. 6 show embodiments for the arrangement of the supports. Whilst in the construction of the device of FIG. 3 a radial and axial shift of the forming rollers 28 is still necessary after the changing unit 30, 40 has moved into the processing position, the flow-forming supports can also be offset by 90°. Hence, the radial feed of the forming rollers 28 would be perpendicular to the shift of the changing unit 30, 40 so that no additional axial feed of the forming rollers 28 would be required or the radial feed can be minimized.

FIGS. 5 and 6 show such an optimized arrangement of the flow-forming supports but in this case specifically for a 3×120° arrangement of the forming rollers 28. Here, the feed of the changing units 30, 40 takes place in an optimum manner which is not at 90° but only at 60°, precisely between the two forming rollers 28. This eliminates the axial feed, yet a radial feed at a greater height is accepted.

The invention claimed is:

1. A device for forming comprising at least one spindle which can be driven in a rotating manner by a rotary drive, at least one clamping means which is arranged on the at least one spindle and structured to receive and clamp a workpiece on the at least one spindle, and at least one forming roller which can be fed axially and/or radially relative to the workpiece in order to carry out a spinning or flow-forming process, wherein one of the at least one spindle and one of the at least one clamping means are combined to one of at least one changing unit which is adjustable transversely to the axis of rotation, and the at least one changing unit is adjustable between a forming position, in which the spinning or flow-forming process is carried out, and a set-up position for setting up, wherein a first changing unit of the at least one changing unit with a first spindle of the at least one spindle and a first clamping means of the at least one clamping means and at least one second changing unit of the at least one changing unit with a second spindle of the at least one spindle and a second clamping means of the at least one clamping means are provided and the first changing unit and the at least one second changing unit are alternately adjustable between the forming position and the set-up position, wherein each of the first changing unit and the at least one second changing unit includes a loading and unloading means comprising a multiaxial robot having a gripper, for loading and unloading the workpiece to and from the respective changing unit, and wherein in the forming position, the workpiece is clamped and held on the at least one spindle on two sides with a counter-holder.

2. The device according to claim 1, wherein the first and second changing units each have a rotary drive of their own.

3. The device according to claim 1, wherein the set-up position is located on the outside of a housing of the device.

4. The device according to claim 1, wherein the at least one changing unit is supported in a pivotable or linearly displaceable manner.

5. The device according to claim 1, wherein the first changing unit and the at least one second changing unit are arranged on a joint adjustment element.

6. The device according to claim 1, wherein the axis of rotation is arranged horizontally or vertically.

7. The device according to claim 1, wherein in order to carry out the spinning or flow-forming process the at least one forming roller is axially stationary, wherein the workpiece is supported in an axially displaceable manner.

8. The device according to claim 1, wherein at the set-up position a loading and unloading means is provided.

9. The device according to claim 1, wherein the workpiece can be reclamped from the first changing unit to the second changing unit.

10. The device according to claim 1, wherein the at least one forming roller is supported on an adjustable roller support and in that on the roller support a roller changing means is arranged.

11. A method for forming, using the device according to claim 1, comprising the at least one spindle is driven in a rotating manner by means of the rotary drive, the workpiece is received on the one of the at least one spindle by the one of the at least one clamping means and clamped on the one of the at least one spindle, and the at least one forming roller is fed axially and/or radially relative to the workpiece in order to carry out a spinning or flow-forming process, wherein the one of the at least one spindle and the one of the at least one clamping means are combined to the one of the at least one changing unit which is adjusted transversely to the axis of rotation between the forming position, in which the spinning or flow-forming process is carried out, and the set-up position for setting up, wherein the first changing unit with the first spindle and the first clamping means and the at least one second changing unit with the second spindle and the second clamping means are provided, wherein the first changing unit and the at least one second changing unit are alternately adjusted between the forming position and the set-up position;

wherein each of the loading and unloading means loads and unloads the workpiece to and from a respective one of the first changing unit and the at least one second changing unit; and in the forming position, the workpiece is clamped and held on the one of the at least one spindle on two sides with the counter-holder.

12. The method according to claim 11, wherein for adjustment between the forming position and the set-up position the one of the at least one changing unit is linearly displaced or pivoted.

13. The method according to claim 11, wherein in order to carry out the spinning or flow-forming process the at least one forming roller is axially stationary, wherein the workpiece is displaced axially.

* * * * *